United States Patent [19]

van Voorst Vader et al.

[11] Patent Number: 4,732,703

[45] Date of Patent: Mar. 22, 1988

[54] LIQUID DETERGENT COMPOSITIONS CONTAINING STABILIZERS TO PREVENT PHASE SEPARATION

[75] Inventors: Frederik van Voorst Vader, Vlaardingen; Wilhelmina K. Toet, The Hague; Johannes C. van de Pas, Vlaardingen, all of Netherlands

[73] Assignee: Lever Brothers Company, New York, N.Y.

[21] Appl. No.: 14,102

[22] Filed: Feb. 3, 1987

Related U.S. Application Data

[63] Continuation of Ser. No. 697,827, Feb. 4, 1985, abandoned.

[30] Foreign Application Priority Data

Feb. 16, 1984 [GB] United Kingdom ..... 8404120

[51] Int. Cl.[4] ..... C11D 3/04; C11D 3/34; C11D 3/36; C11D 17/08

[52] U.S. Cl. ..... 252/532; 252/89.1; 252/173; 252/174.16; 252/174.19; 252/174.21; 252/174.22; 252/528; 252/534; 252/540; 252/547; 252/551; 252/553; 252/559; 252/DIG. 1; 252/DIG. 14; 252/DIG. 17

[58] Field of Search ..... 252/89.1, 174.16, 174.19, 252/174.21, 174.22, 173, 528, 532, 534, 547, 551, 553, 559, 540, DIG. 1, DIG. 14, DIG. 17

[56] References Cited

U.S. PATENT DOCUMENTS

| | | | |
|---|---|---|---|
| 3,501,409 | 3/1970 | Matson | 252/548 |
| 3,725,290 | 4/1973 | Nelson | 252/110 |
| 3,816,318 | 6/1974 | Hentschel | 252/174.19 |
| 3,893,955 | 7/1975 | Hewitt | 252/174.19 |
| 3,896,040 | 7/1975 | Danesh | 252/135 |
| 3,941,710 | 3/1976 | Gilbert | 252/99 |
| 3,958,928 | 5/1976 | Lala | 8/25 |
| 4,079,078 | 3/1978 | Collins | 252/559 |
| 4,384,978 | 5/1983 | Ploog et al. | 252/353 |
| 4,446,043 | 5/1984 | Tai | 252/105 |

*Primary Examiner*—Dennis Albrecht
*Attorney, Agent, or Firm*—Gerard J. McGowan, Jr.; James J. Farrell

[57] ABSTRACT

The invention pertains to aqueous liquid detergent compositions on the basis of nonionic and anionic or cationic detergents and electrolytes which include a effective amount of an anionic alkylpolyalkylene oxide derivative selected from the group consisting of:

(1) anionic alkylpolyalkyleneoxide derivatives having the formula:

$$Y-(CH_2)_p-[O-(CH_2)_n]_z-O-(CH_2)_q-X,$$

(2) anionic di(alkylpolyalkyleneoxide) derivatives having the formula:

$$\begin{matrix} H-(CH_2)_p-[O-(CH_2)_n]_y-O \\ \qquad\qquad\qquad\qquad\qquad\qquad R-X, \text{ and} \\ H-(CH_2)_p-[O-(CH_2)_n]_x-O \end{matrix}$$

(3) anionic di(alkylpolyalkyleneoxide) derivatives having the formula:

$$\begin{matrix} H-(CH_2)_p-[O-(CH_2)_n]_y \\ \qquad\qquad\qquad\qquad\qquad\qquad Z \\ H-(CH_2)_p-[O-(CH_2)_n]_x \end{matrix}$$

in which X is a salt of a mono-valent oxygen-containing anionic group, Y is hydrogen or a salt of a mono-valent oxygen-containing anionic group, Z is a phosphate or phosphonate salt, R is $C_1$-$C_3$ alkynyl, q is 0–4, p is 0–4, z is 1–14, x is 0–14, y is 0–14 and x+y is 1–14 and n is 2–3.

Inclusion of the alkylpolyalkyleneoxide derivatives results in an improvement of the long term storage stability of the detergent composition.

10 Claims, No Drawings

LIQUID DETERGENT COMPOSITIONS CONTAINING STABILIZERS TO PREVENT PHASE SEPARATION

This is a continuation of application Ser. No. 697,827, filed Feb. 4, 1985, now abandoned.

The present invention relates to aqueous liquid detergent compositions, and more in particular to such compositions comprising a nonionic detergent active material and/or an anionic derivative of a polyalkoxylated nonionic detergent active material, at least one anionic and/or cationic detergent active material, and electrolytes.

This type of composition is well-known in the art, an important example thereof being aqueous built liquid detergent compositions which comprise one or more builder salts. It is generally known that special measures are required to provide such compositions with satisfactory stability thereby avoiding phase separation on long term storage. Such measures may include a critical balancing of the various ingredients, the use of special stabilizers, or the use of special processing steps.

Analogous stability problems may occur with electrolytes other than builder salts, such as buffer salts, pH adjusting agents, fillers and the like.

It has now been found that the instability problems in the above type of systems can be significantly reduced by inclusion therein of a special class of compounds which are mono- or dianionic derivatives of polyalkylene oxides to be specified hereunder in more detail.

Accordingly, the present invention provides an aqueous liquid detergent composition which comprises:

(a) a nonionic detergent-active material and/or an anionic derivative of a polyalkoxylated nonionic detergent-active material;

(b) an anionic detergent-active material other than component (a) and/or a cationic detergent-active material;

(c) one or more electrolytes; and (d) an effective amount of a stabilizing compound or mixture of stabilizing compounds selected from the group consisting of:

(1) anionic alkylpolyalkyleneoxide derivatives having the formula:

$$Y-(CH_2)_p-[O-(CH_2)_n]_z-O-(CH_2)_q-X,$$

(2) anionic di(alkylpolyalkyleneoxide) derivatives having the formula:

$$\begin{matrix} H-(CH_2)_p-[O-(CH_2)_n]_y-O \\ \qquad\qquad\qquad\qquad\qquad\qquad R-X, \text{ and} \\ H-(CH_2)_p-[O-(CH_2)_n]_x-O \end{matrix}$$

(3) anionic di(alkylpolyalkyleneoxide) derivatives having the formula:

$$\begin{matrix} H-(CH_2)_p-[O-(CH_2)_n]_y \\ \qquad\qquad\qquad\qquad\qquad\qquad Z \\ H-(CH_2)_p-[O-(CH_2)_n]_x \end{matrix}$$

in which X is a salt of a mono-valent oxygen-containing anionic group, Y is hydrogen or a salt of a mono-valent oxygen-containing anionic group, Z is a phosphate or phosphonate salt, R is $C_1$–$C_3$ alkynyl, q is 0–4, p is 0–4, z is 1–14, x is 0–14, y is 0–14 and x+y is 1–14 and n is 2–3.

The stabilizing compounds of the present invention belong to the class of salts of anionic alkylpolyalkylene oxide derivatives.

In the preceding formulas, the polyalkylene oxide portions $[O-(CH_2)_n]_{x,y,z}$, of the stabilizing compound preferably consist solely of ethylene oxide units, but also mixtures of ethylene oxide and propylene oxide are suitable. The number of alkylene oxide units (x+y,z) may range from 1 to 14, and preferably lies within the range of 2 to 12, the range of 4 to 10 being preferred most.

The group X is a salt of a mono-valent oxygen-containing anionic group. Suitable are salts of oxides of carbon, sulphur and phosphorus, such as carboxylates, sulphates, sulphonates, sulphinates, thiosulphates, sulphamates, nitroamides, phosphates and phosphonates.

In the case of mono(alkylpolyalkoxylated) stabilizing compounds group X may be attached directly to the alkylene oxide portion of the molecule, i.e. q=0, the end-standing group O=X then preferably being a sulphate salt.

Between the alkylene oxide portion and the anionic group there may also be a short alkylene chain, in which case X preferably is a carboxylate salt. The alkylene chain may consist of up to four carbon atoms (q is 0–4) and preferably is methylene or ethylene.

The group Y preferably is hydrogen, but may also be an salt of a second mono-valent oxygen-containing anionic group. In the latter case Y is selected from the same group as X, and may be equal to or different from X.

Between Y or hydrogen (in the case of di(polyalkoxylated stabilizing compounds) and the alkylene oxide portion a short alkylene chain may be present consisting of up to four carbon atoms. The alkylene chain preferably is a straight saturated alkylene chain, in particular methylene or ethylene.

R is a $C_1$–$C_3$ alkynyl group, X then preferably being a carboxylate salt. Suitable examples of this class of stabilizing compounds are the mono- and di(alkylpolyalkoxylated) glyceric acid salts.

Suitable counter cations for the anionic group(s) are hydrogen, ammonium and alkalimetal ions, preferably sodium, or equivalently charged amounts of alkaline earth metal ions.

In the detergent compositions according to the present invention a single stabilizing agent or mixture thereof is included in an amount which will depend on the concentration and composition of the various detergent actives and the specific type of stabilizing compound which is used. Although the amount is often critical in that a concentration which is either too low or too high may result in non-satisfactory stabilizing behaviour, suitable concentrations can easily be determined by way of routine procedure. In general the concentration of the stabilizing compound or mixture thereof lies within the range of from 0.1 to 30%, in particular from 0.3 to 15%, such as from 0.5 to 5% by weight of the total composition.

The invention is particularly applicable to liquid detergent compositions on the basis of binary or ternary active systems which comprise a nonionic detergent active or anionic derivative of a polyalkoxylated nonionic detergent-active in combination with one or more anionic and/or cationic detergent actives, and electrolytes. The anionic, cationic and nonionic detergent actives used in the present invention can be selected from any suitable conventional materials. The anionics comprise the well-known anionic detergents of the alkylaryl sulphonate type, the alkyl- and alkylether sulphate type, the alkane- and alkene sulphonate type etc. Numerous other examples can be found in Schwartz, Perry, Vol. II, 1958, "Detergents and Surface-Active Agents".

Suitable nonionics detergent actives comprise ethylene oxide and/or propylene oxide condensation products with fatty alcohols, alkylphenols, fatty acids and fatty acid amides. Although also other types of nonionic detergent actives may be suitable, examples of which are given in the above mentioned reference, the alkylene oxide derived nonionic actives are preferred.

As anionic derivatives of polyalkoxylated nonionic detergent active materials, those compounds are contemplated which are derived from alkoxylated nonionics by e.g. sulphation, phosphation or oxidation, such as the sulphated, phosphated or carboxylated polyalkylated nonionic detergent actives.

Examples of cationic detergent-active materials are the quaternary ammonium compounds, such as di-(higher alkyl)di-(lower alkyl)ammonium halides.

Although cationics can be used in combination with the nonionics, it is preferred to use anionic detergent-actives in combination with the nonionic detergent-actives.

The ratio of anionic to nonionic detergent-active may vary from 10:1 to 1:10. In the case where detergent compositions with suspending properties are desired this ratio preferably ranges from 5:1 to 1:1. The total amount of detergent-active material may vary from 2 to 50, preferably from 5 to 35% by weight of the total composition.

The electrolytes which are used in the present invention are those which cause salting-out of the detergent-active. In general the composition may contain from 1 to 60% by weight, preferably from 3 to 50% by weight and most preferably from 5 to 30% by weight of the salting-out electrolyte.

Typical examples of salting-out electrolytes are water-soluble builder salts, such as the alkali metal ortho- and pyrophosphates, the alkali metal and ammonium tripolyphosphates, such as sodium tripolyphosphate, the alkali metal silicates, -borates, -carbonates, -sulphates and -citrates, alkali metal salts of nitrilotriacetate, alkali metal salts of carboxymethyloxysuccinate. Instead of the alkali metal salts also the ammonium salts can be used. Preferred electrolytes are sodium tripolyphosphate and/or sodium (di)-silicate.

The composition of the invention may further contain all ingredients usually encountered in such products, such as enzymes, fluorescers, builders, such as zeolites, abrasives, such as calcite, anti-redeposition agents, germicides, opacifiers, suds boosters, foam depressants, corrosion inhibitors, perfumes, bleaching agents, bleach percursors, non-salting-out electrolytes, solvents, etc.

The invention will now be further illustrated by way of example, in which all percentages are by weight of the total composition unless otherwise indicated.

EXAMPLE I

Detergent compositions A to E were prepared according to the following formulations.

| Ingredient | % A | B | C | D | E |
|---|---|---|---|---|---|
| sodium dodecyl benzene sulphonate | 14.4. | 11.3 | 8.9 | 8.8 | 6.4 |
| $C_{13}$–$C_{15}$ alcohol condensed with 11 moles of ethylene oxide | 3.3 | — | — | — | — |
| $C_{13}$–$C_{15}$ alcohol condensed with 7 moles of ethylene oxide | — | 6.1 | 8.9 | — | 3.0 |
| $C_{13}$–$C_{15}$ alcohol condensed with 2.8 moles of ethylene oxide | — | — | — | 8.8 | — |
| sodium $C_{12}$–$C_{15}$ alcohol ethoxy (3EO) sulphate | — | — | — | — | 1.0 |
| sodium tripolyphosphate | 10.3 | — | — | — | 25.0 |
| sodium disilicate | 4.3 | — | — | 11.6 | — |
| sodium nitrilotriacetate.HO | — | 13.1 | 10.8 | — | — |
| glycerol | — | — | — | — | 5.0 |
| $Na_2B_4O_7.10H_2O$ | — | — | — | — | 3.6 |
| water | | | balance | | |

The stabilizing effect on the above compositions was assessed for the following compounds:

Stabilizer 1: $H_3C—CH_2O—(C_2H_4O)_{2.3}—SO_3Na$

Stabilizer 2: $H_3C—O—(C_2H_4O)_{10.1}—SO_3Na$

Stabilizer 3: $H_3C—O—(C_2H_4O)_{4.5}—CH_2—COONa$

Stabilizer 4: $H_3C—O—(C_2H_4O)_{10.1}—CH_2—COONa$

The above stabilizers were included in the compositions A–E in various concentrations. In Table I to IV the stability results are listed which clearly indicate the improvements in stability and the concentration dependence thereof.

Compositions were considered stable if less than 1% phase separation occurred, unstable, if more than 3% phase separation occurred.

Stability results are expressed in days of storage at ambient temperatures during which the composition remained stable.

TABLE I

| Detergent composition | Stabilizer 1 concentration of stabilizer (%) 0 | 0.50 | 1.01 | 2.00 | 3.86 | 7.6 | 14.1 |
|---|---|---|---|---|---|---|---|
| A | <1 | <1 | >60 | 42 | 3 | <1 | — |
| B | <1 | <1 | <1 | <1 | 35 | 40 | >60 |
| C | <1 | <1 | <1 | <1 | <1 | 5 | >60 |

TABLE II

| Detergent composition | Stabilizer 2 concentration of stabilizer (%) 0 | 0.52 | 0.97 | 1.93 | 3.78 | 7.0 | 13.5 |
|---|---|---|---|---|---|---|---|
| A | <1 | <1 | >60 | <1 | <1 | <1 | <1 |
| B | <1 | <1 | <1 | <1 | >60 | >60 | >60 |
| C | <1 | <1 | <1 | <1 | 2 | >60 | 40 |
| D | <1 | <1 | <1 | 7 | 24 | 12 | 5 |

TABLE III

| Detergent composition | Stabilizer 3 concentration of stabilizer (%) 0 | 0.28 | 0.56 | 1.14 | 2.24 | 4.4 | 8.5 |
|---|---|---|---|---|---|---|---|
| A | <1 | <1 | >60 | 42 | <1 | <1 | <1 |
| D | <1 | <1 | <1 | <1 | <1 | <1 | 40 |
| E | 14 | >60 | >60 | >60 | 35 | 30 | <1 |

TABLE IV

| Detergent composition | Stabilizer 4 concentration of stabilizer (%) 0 | 0.45 | 0.82 | 1.64 | 3.23 | 6.3 | 11.8 | 20.8 |
|---|---|---|---|---|---|---|---|---|
| A | <1 | <1 | >60 | <1 | <1 | <1 | <1 | — |
| D | <1 | <1 | <1 | <1 | <1 | <1 | >60 | <1 |
| E | 14 | >60 | >60 | 50 | 9 | 5 | 2 | — |

EXAMPLE II

A detergent composition based on a cationic/nonionic surfactant combination was prepared according to the following formulation:

| Ingredient | % |
|---|---|
| dicocodimethylammoniumchloride | 9.8 |
| $C_{13}$-$C_{15}$ alcohol condensed with 7 moles of ethylene oxide | 9.8 |
| sodium disilicate | 3.0 |
| isopropanol | 3.3 |
| water | balance |

The stability of the above composition was assessed using variable amounts of the stabilizer 1 as given in example I.

In table V the stability results are presented clearly indicating the advantageous effects on stability in the above system.

The same stability criterium was used as in example I and results are expressed as days of storage at ambient temperatures during which the composition remained stable.

TABLE V

| concentration of stabilizer (%) | days of stable storage |
|---|---|
| 0 | <4 |
| 0.56 | <4 |
| 2.22 | <4 |
| 4.34 | 15 |
| 8.32 | >60 |
| 15.36 | 40 |

EXAMPLE III

Using formulation A of example I, the following compounds were assessed on their effect on stability:

Stabilizer 5: $HO—(C_2H_4O)_{4.1}—CH_2—COONa$

Stabilizer 6: $HO—(C_2H_4O)_{8.7}—CH_2—COONa$

Stabilizer 7: $NaOOC—CH_2O—(C_2H_4O)_{4.1}—CH_2—COONa$

Stabilizer 8: $NaOOC—CH_2O—(C_2H_4O)_{8.7}—CH_2—COONa$

Stabilizer 9: $H_3C—O—(C_2H_4O)_{7.2}—CH_2—COONa$

Stabilizer 10: $H_2C—O—(C_2H_4O)_{7.2}—SO_3Na$

Stabilizer 11: $H_3C—O—(C_2H_4O)_{11.8}—SO_3Na$

Compound I: $H_3C—O—(C_2H_4O)_{16.3}—CH_2—COONa$

Compound II: $H_3C—O—(C_2H_4O)_{16.3}—SO_3Na$

Stability results expressed as days of stable storage at ambient temperatures, are given in tables VI and VII for stabilizers 5 to 11.

For reasons of comparison stability results for compounds I and II are listed in table VIII, the results clearly showing the poor stabilizing properties of comparable compounds which lie outside the scope of the present invention.

TABLE VI

| stabilizer 5 conc (%) | days | stabilizer 6 conc (%) | days | stabilizer 7 conc (%) | days | stabilizer 8 conc (%) | days |
|---|---|---|---|---|---|---|---|
| 0 | <1 | 0.36 | <1 | 0.32 | <1 | 0.41 | 3 |
| 0.23 | <1 | 0.72 | 15 | 0.67 | 15 | 0.81 | 25 |
| 0.45 | <1 | 1.42 | >60 | 1.19 | 40 | 1.59 | >60 |
| 0.89 | 50 | 2.77 | <1 | 2.36 | <1 | 3.14 | <1 |
| 1.77 | >60 | 5.37 | <1 | 4.59 | <1 | 6.05 | <1 |
| 3.39 | >60 | 10.19 | <1 | 8.66 | <1 | 11.29 | <1 |

TABLE VII

| stabilizer 9 conc (%) | days | stabilizer 10 conc (%) | days | stabilizer 11 conc (%) | days |
|---|---|---|---|---|---|
| 0.30 | <1 | 0.35 | <1 | 0.47 | <1 |
| 0.57 | >60 | 0.67 | >60 | 0.67 | >60 |
| 1.17 | <1 | 1.34 | <1 | 0.89 | >60 |
| 2.29 | <1 | 2.63 | <1 | 1.78 | <1 |
| 4.43 | <1 | 5.07 | <1 | 3.53 | <1 |

TABLE VIII

| compound I conc (%) | days | compound II conc (%) | days |
|---|---|---|---|
| 0.59 | <1 | 0.62 | <1 |
| 0.89 | <1 | 0.89 | <1 |
| 1.18 | <1 | 1.23 | <1 |
| 2.33 | <1 | 2.33 | <1 |
| 4.53 | <1 | 4.67 | <1 |
| 8.59 | <1 | 8.90 | <1 |

We claim:

1. An aqueous liquid detergent composition having suspending properties which comprises:

(1) from 5 to 50% by weight of detergent-active mixture consisting essentially of:

(a) a detergent-active material selected from the group consisting of nonionic detergent-active materials and anionic derivatives of polyalkoxylated nonionic detergent-active materials, and (b) a detergent-active material selected from the group consisting of anionic detergent-active materials other than component (a) and cationic detergent-active materials, the weight ratio between component (a) and component (b) being within the range of 1:5 to 1:1;

(2) from 3 to 50% by weight of one or more salting-out electrolytes selected from the group consisting of the alkali metal and ammonium orthophosphates, -pyrophosphates, -tripolyphosphates, -silicates, -borates, -carbonates, -sulphates, -citrates, -nitrilotriacetates and -carboxymethyloxysuccinates in an amount that would cause the component (1) surfactants to salt out during a storage period of 14 days or less in the absence of component (3); and (3) from 0.1 to 30% by weight of a stabilizing compound or mixture of stabilizing compounds selected from the group consisting of:

(I) anionic alkylpolyalkyleneoxide derivatives having the formula $$Y—(CH_2)_p—[O—(CH_2)_n]_z—O—(CH_2)_q—X,$$

(II) anionic di(alkylpolyalkyleneoxide) derivatives having the formula:

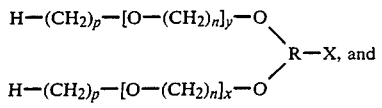

(III) anionic di(alkylpolyalkyleneoxide) derivatives having the formula:

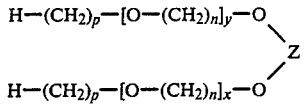

in which X is a salt of a mono-valent oxygen-containing anionic group, Y is hydrogen or a salt of a mono-valent oxygen-containing anionic group, Z is a phosphate or phosphonate salt, R is $C_1$–$C_3$ alkynyl, q is 0–4, p is 0–4, z is 4–10, x is 0–10, y is 0–10 and x+y is 4–10 and n is 2–3, said stabilizing compound being present in an amount sufficient to prevent phase separation for a storage period of at least 60 days.

2. Composition according to claim 1 wherein n is 2.

3. Composition according to claim 1 wherein z is 4–10.

4. Composition according to claim 1 wherein q is 0 the end-standing group O—X being a sulphate.

5. Composition according to claim 1 wherein X is a carboxylate salt.

6. Composition according to claim 5 wherein q is 1–2.

7. Composition according to claim 1 wherein Y is hydrogen.

8. Composition according to claim 1 which comprises from 0.3 to 15% by weight of component (3).

9. Composition according to claim 1 which comprises from 5 to 35% by weight of detergent-active material and from 3 to 50% by weight of a salting-out electrolyte.

10. Composition according to claim 1 wherein the electrolytes are selected from sodium tripolyphosphate, sodium (di)-silicate and mixtures thereof.

* * * * *